United States Patent [19]

Suzuki et al.

[11] Patent Number: 4,982,579

[45] Date of Patent: Jan. 8, 1991

[54] EVAPORATOR

[75] Inventors: Katsuhisa Suzuki; Hiroshi Matsubayashi, both of Tochigi, Japan

[73] Assignee: Showa Aluminum Corporation, Osaka, Japan

[21] Appl. No.: 499,841

[22] Filed: Mar. 27, 1990

[30] Foreign Application Priority Data

Mar. 31, 1989 [JP] Japan ..... 1-82746

[51] Int. Cl.[5] ..... F25B 39/02

[52] U.S. Cl. ..... 62/515; 165/110

[58] Field of Search ..... 165/110, 111; 62/515

[56] References Cited

U.S. PATENT DOCUMENTS 4,350,025 7/1982 Izumi ..... 62/515 X 4,914,929 4/1990 Shimazaki ..... 62/515

4,936,379 6/1990 Hoshino et al. ..... 165/110 X

*Primary Examiner*—Lloyd L. King

*Attorney, Agent, or Firm*—Armstrong, Nikaido, Marmelstein, Kubovcik, & Murray

[57] ABSTRACT

An evaporator adapted to efficiently release water drops from its corrugated fins without lowering its performance by suitably determining the pitch of flat poritons of each fin and height of louvers formed on the flat portions in combination with the pitch. The evaporator is characterized in that the corrugated fin is 0.75 to 0.90 in the ratio of H/P wherein P is the pitch, and H is the height.

3 Claims, 4 Drawing Sheets

EVAPORATOR

BACKGROUND OF THE INVENTION

The present invention relates to evaporators for use in motor vehicle air conditioners and the like.

When air is cooled with evaporators, water vapor in the air condenses, and the condensate is deposited on the fins in the form of water drops, which are released from the fins on falling under gravity. To give improved water releasability, it has been attempted to subject the surface of the fin to a chemical hydrophilic treatment.

While the fin is formed with louvers, the shape of louvers is determined primarily for improving the cooling performance of the evaporator and depressing the increase in pressure loss without giving consideration to the releasability of water drops from the louvers.

SUMMARY OF THE INVENTION

The main object of the present invention is to provide an evaporator exhibiting improved cooling performance with the increase in pressure loss depressed and having satisfactory water drop releasability.

The present invention provides an evaporator comprising a corrugated fin having flat portions, each of the flat portions being formed with louvers arranged in parallel and extending widthwise of the flat portion, the evaporator being characterized in that the corrugated fin is 0.75 to 0.90 in the ratio of H/P wherein P is the pitch of the flat portions of the fin, and H is the height of the louvers.

The evaporator of the present invention achieves an improved cooling efficiency, diminished in the increase of pressure loss and satisfactorily releases water drops.

DESCRIPTION OF THE PREFERRED EMBODIMENTS

Embodiments of the present invention will be described below with reference to the drawings.

Figure 3:
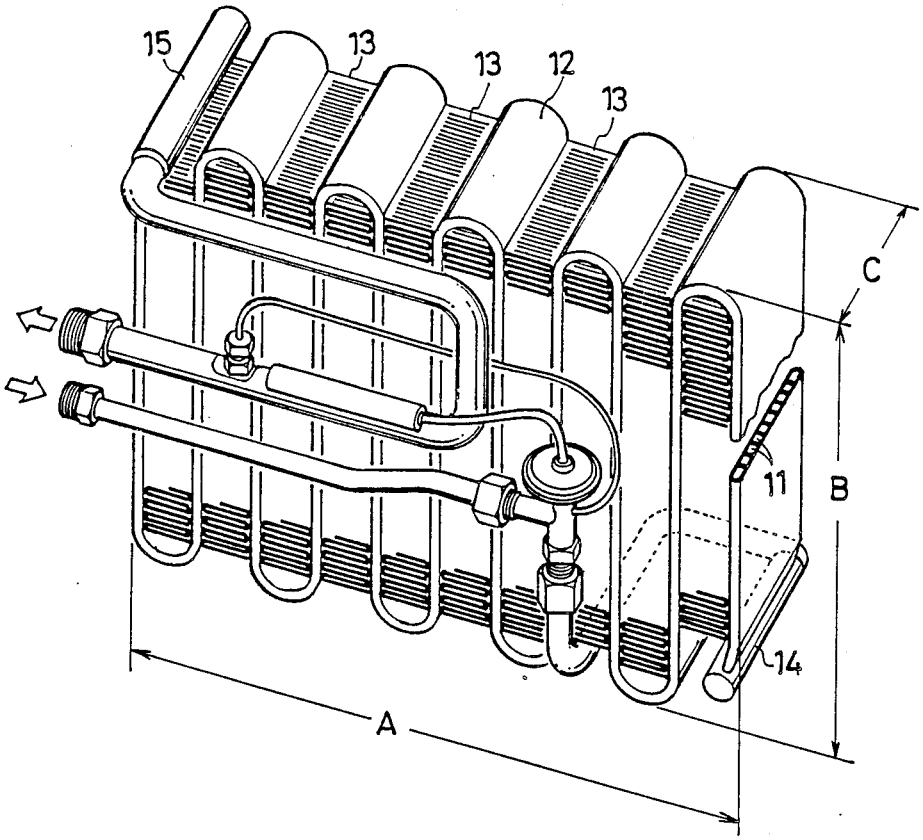
FIG. 3 is a perspective view of the evaporator of FIG. 1 in its entirety.

FIG. 3 shows an evaporator of the invention which comprises a zigzag flat tube 12 made of an aluminum extrudate and having parallel refrigerant channels 11, louvered corrugated fins 13 each made of an aluminum brazing sheet and provided between the adjacent straight tube portions of the flat tube 12, and an inlet header 14 and an outlet header 15 provided at the respective ends of the flat tube 12. The flat tube 12 and the fins 13 have their surfaces coated with a hydrophilic film.

Figure 4:
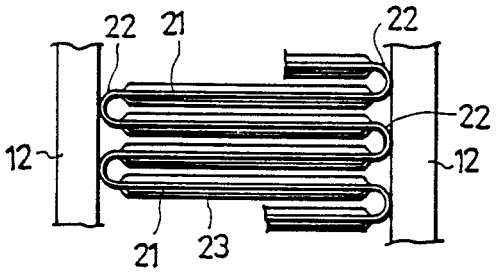
FIG. 4 is an enlarged fragmentary front view of the fin.
Figure 5:
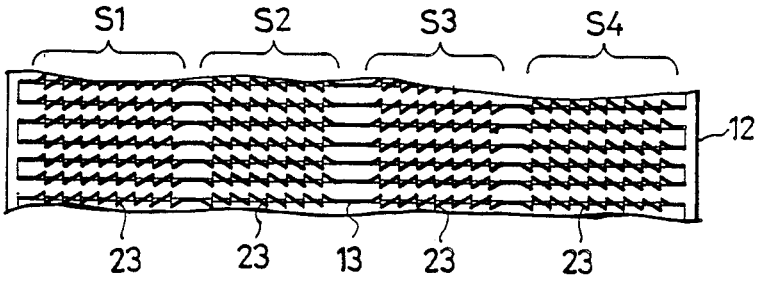
FIG. 5 is a fragmentary view in vertical section of the fin.

As shown in detail in FIG. 4, the corrugated fin 13 comprises flat portions 21 arranged in parallel, and U-shaped bent portions 22 each interconnecting the ends of each pair of adjacent flat portions 21 which ends are positioned on the same side. Each flat portion 21 is formed with louvers 23 arranged in parallel and extending widthwise thereof over the entire width. Between the adjacent louvers 23, a slit 24 is formed by louvering. As seen in FIG. 5, the louvers 23 formed in each flat portion 21 are divided into four groups S1 to S4, and the louvers 23 of every other group are oriented in the same direction.

Figure 1:
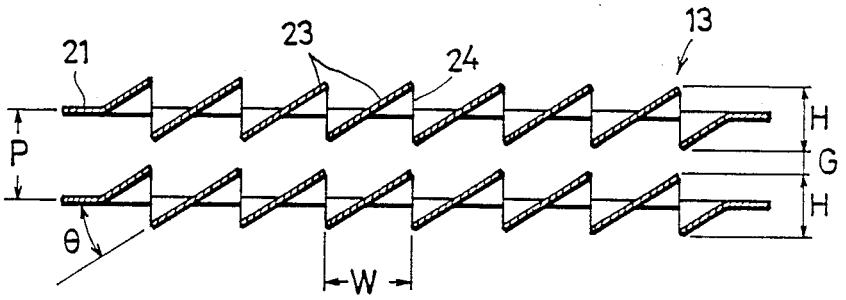
FIG. 1 is a diagram illustrating the fin of an evaporator embodying the invention.

FIG. 1 shows important factors in designing the fin 13. They are:

P: pitch of flat portions of the fin, mm.

$\theta$: angle of the louver, deg.

W: width of the louver, mm.

H: height of the louver, mm.

G: gap (P–H) between louvers, mm.

With the corrugated fin 13 described, condensed vaper, i.e., water, flows down from one flat portion 21 to the next underlying flat portion 21 through the slits 24, so that the water flows down with greater ease as the pitch P decreases. When the height H of the louvers 23 is constant, the smaller the gap G between the louvers, the smaller is the pitch P, permitting the condensation water to flow down more easily.

The preferred specific numerical values of the above factors are: P=1.8 to 2.2, $\theta$=28 to 38, and W=2.3 to 2.7. The height of the louvers is calculated from the equation: $H=W\cdot\tan\theta$.

As another factor serving as a standard for designing fins, the gap ratio is defined as H/P. The greater the gap ratio, the greater is the effect to permit the condensation water to flow down.

Table 1 below shows specific values of the foregoing factors collectively.

TABLE 1

| W | $\theta$ | H | P | G | H/P | Evaluation |
|---|---|---|---|---|---|---|
| 2.5 | 32 | 1.562 | 2.0 | 0.438 | 0.781 | Good |
| ↑ | ↑ | ↑ | 1.8 | 0.238 | 0.868 | Good |
| 2.5 | 38 | 1.953 | 2.0 | 0.047 | 0.977 | Poor |
| 2.3 | 32 | 1.437 | 2.0 | 0.563 | 0.719 | Poor |
| ↑ | ↑ | ↑ | 1.8 | 0.363 | 0.798 | Good |
| 2.3 | 38 | 1.797 | 2.0 | 0.203 | 0.898 | Good |
| ↑ | ↑ | ↑ | 1.8 | 0.003 | 0.998 | Poor |
| 2.3 | 40 | 1.930 | 2.0 | 0.070 | 0.965 | Poor |

Figure 2:
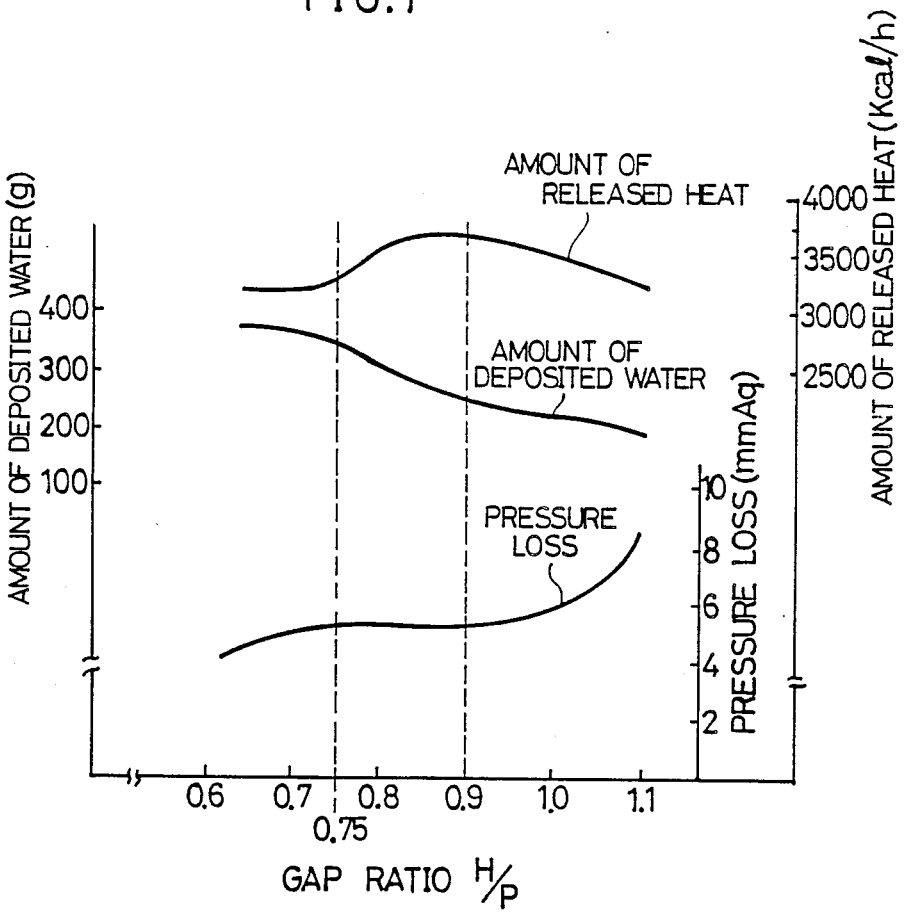
FIG. 2 is a graph showing characteristics of the evaporator.

Although the gap ratio has been checked only for the effect to cause condensation water to flow down, cooling performance and pressure loss are also important characteristics of evaporators. FIG. 2 is a graph showing the relationship of the gap ratio with these characteristics and the effect to release water. The items of data on the graph are actual measurements obtained with use of an evaporator 320 mm in width A, 230 mm in height B and 90 mm in depth C (see FIG. 3). While these dimensions are variable as desired, it is especially preferable that the depth C be 65 to 110 mm.

FIG. 2 reveals that when the gap ratio H/P is in the range of 0.75 to 0.90, all the characteristics requirements can be fulfilled.

When the above-mentioned factors are considered collectively, it is desirable to make the louver angle $\theta$ small if the width W of the louver is great, or in the case where the louver width W is small, the louver angle $\theta$ should be small to decrease the pitch P, or the louver angle 8 should be great to increase the pitch P.

Figure 6:
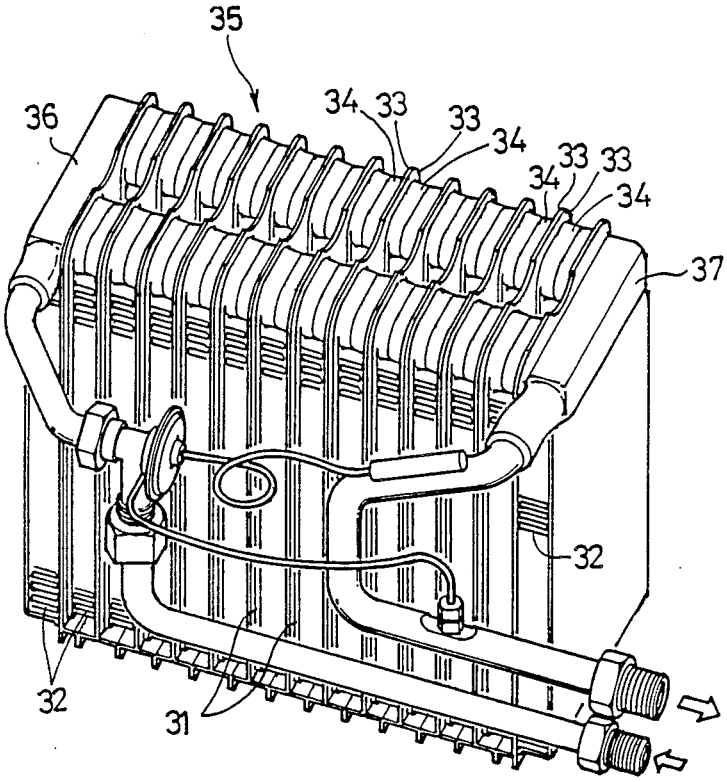
FIG. 6 is a perspective view showing another evaporator in its entirety.

FIG. 6 shows another type of evaporator. This evaporator comprises flat tubes 31 arranged in parallel, and corrugated fins 32 interposed between the adjacent flat tubes 31. Each flat tube 31 comprises two brazing sheets 33 press-formed generally in the shape of a trough and joined together face-to-face to form a refrigerant channel between the two sheets 33. The flat tube 31 is formed at its upper portion with a bulging portion 34. Each pair of adjacent bulging portions 34 are joined togther in communication to thereby provide a header tank 35. An inlet pipe 36 and an outlet pipe 37 are connected to the header tank 35. The corrugated fin 32 is the same as the fin 13 of the evaporator shown in FIG. 3.

What is claimed is:

1. An evaporator comprising a corrugated fin having flat portions, each of the flat portions being formed with louvers arranged in parallel and extending widthwise of the flat portion, the evaporator being characterized in that the corrugated fin is 0.75 to 0.90 in the ratio of H/P wherein P is the pitch of the flat portions of the fin, and H is the height of the louvers.

2. An evaporator as defined in claim 1 wherein the pitch of the flat portions of the fin is 1.8 to 2.2 mm.

3. An evaporator as defined in claim 1 wherein the width of the louvers is 2.3 to 2.7 mm, and the angle of the louvers is 28 to 38 deg.

* * * * *